US005123306A

United States Patent [19]

Saunders et al.

[11] Patent Number: 5,123,306

[45] Date of Patent: Jun. 23, 1992

[54] PIN PULLING TOOL

[76] Inventors: Nathan S. Saunders, 30 Howe Rd., Fairfield, Me. 04937; David J. Moretti, R.R.#1 Box 314, Belgrade, Me. 04917

[21] Appl. No.: 723,093

[22] Filed: Jun. 28, 1991

[51] Int. Cl.[5] ..... B67B 07/00

[52] U.S. Cl. ..... 81/3.08; 81/3.07

[58] Field of Search ..... 81/3.08, 3.07, 3.09, 81/3.05, 3.25, 3.27, 45, 46

[56] References Cited

U.S. PATENT DOCUMENTS

| | | | |
|---|---|---|---|
| 3,257,872 | 6/1966 | Coppola | 81/3.08 |
| 3,987,827 | 10/1976 | Mills | 81/45 |
| 4,296,653 | 10/1981 | Lundgren et al. | 81/3.08 |
| 4,663,995 | 5/1987 | Amundson et al. | 81/45 |

*Primary Examiner*—Bruce M. Kisliuk
*Assistant Examiner*—Lawrence Cruz

[57] ABSTRACT

A tool for removing the pins that block the opposite ends of an electrical component storage tube, each pin including a shank and an enlarged head at one end of the shank. The tool includes a wedge having a relatively sharp edge and opposite surfaces which diverge from that edge. At least one slot is formed in the wedge which extends between those surfaces and is directed away from the edge to a location on the wedge between those opposite surfaces exceeds the length of the pin shank. Preferably, a pair of guide members are mounted to the wedge member on opposite sides of each slot for engaging and guiding a tube in the general direction of the slot, the spacing of the opposing walls of each member pair being somewhat greater than that of the tube walls. Preferably, the tool is adjustably mounted to a support so that its tool engaging surface can be oriented horizontally, vertically or any angle in between to suite the user of the tool. Also, the tool support may include an open-top receptacle over which the tool may be mounted so that the pins pulled from the tube can fall into the receptacle.

20 Claims, 2 Drawing Sheets

PIN PULLING TOOL

This invention relates to a tool for pulling the retaining pins that close the ends of shipping or storage tubes containing electrical components so that the components can be removed from the tubes for assembly.

BACKGROUND OF THE INVENTION

The manufacturers of certain electrical components such as dual in-line package (DIP) integrated circuits customarily ship those components to the users thereof in reusable rigid plastic tubes in order to protect the components during shipping and handling. Each tube may be long enough to hold twenty or more components arranged end to end. The components are retained in each tube by plastic pins passed through the tube walls at the opposite ends of the tube. These pins have a shank which is terminated at one end by a relatively large head. The other end of the shank is shaped to form a laterally compressible enlargement or bulb. The pin is somewhat longer than the tube cross section so that the pin can be inserted through aligned holes in the opposite walls of the tube. Those holes are larger than the pin shank but smaller than the enlargement so that when the pin shank with its enlargement is inserted through the two holes and a forward thrust is applied to the head of the pin, the pin enlargement "snaps" through the hole in the far wall thereby retaining the pin in place.

The OEM or other user that receives the loaded tubes must remove at least one of the pins from each tube before the components can be removed from the tubes. In actual practice, a worker manually pulls out one pin and positions the tube in an automated placement machine. In that machine, the components are caused to slide out of the tube, one by one, through the open end thereof for placement on a printed circuit board. Then, after the tube is empty, it is removed from that machine and the worker pulls out the pin at the other end of the tube so that the tube can be sent back to the component supplier for recycling.

Conventionally, the retaining pins are jacked out of the tube manually using side-cutters or a similar hand tool. The removal procedure involves holding the tube with one hand and, using the other hand, inserting the cutter blades between the pin head and the tube wall, bracketing the pin shank, and with a wrist twisting motion, jacking and pulling the pin away from the tube until the pin enlargement squeezes back through the holes in the tube walls. Once removed, the pins are placed in a container for disposal. More often than not, however, the pins drop to the workbench or floor necessitating cleanup later.

Needless to say, pin removal is a tedious and time-consuming task involving a completely repetitive, two-hand process that contributes to the risk of wrist injury and of cumulative trauma developing in the personnel that service the component placement machines.

While at first glance the problem of pin removal does not appear to be particularly momentous, it should be borne in mind that many millions of components stored in tubes are used each year, requiring removal of millions of pins from those tubes. If it takes only a few seconds to remove each pin in the conventional way, it can readily be seen that hundreds of manhours per year are completely wasted, because pin removal does not add any value whatsoever to the product being built from the components.

SUMMARY OF THE INVENTION

This invention aims to provide a tool to facilitate the removal of retaining pins that close the ends of electrical component storage tubes.

It is another object of the invention to provide a tool that permits removal of the pins from the tubes quickly and efficiently without causing damage to the tubes.

Still another object of the invention is to provide a pin removal tool of this general type which reduces the risk of wrist injury to personnel assigned to remove electrical components from their storage tubes for assembly.

A further object of the invention is to provide such a tool which enables pin removal using only one hand.

Yet another object of the invention is to provide a pin removal tube which can be ergonomically adapted to workers having different heights and physiques.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our tool comprises a rigid, wedge-shaped plate having a front, a rear and opposite sides. The upper surface of the plate is generally flat and the lower surface is inclined forming a relatively sharp edge at the rear of the plate. One or more slots extend from the sharp rear edge of the plate toward the front of the plate, each slot extending entirely through the plate. Each slot is somewhat wider than the cross section of the shank of a conventional retaining pin used to close the end of an electronic component storage tube. Also, a pair of parallel spaced-apart guides may be present on the upper surface of the plate which brackets each slot, the spacing between each pair of guides being slightly greater than the cross section of a conventional electrical component storage tube.

The tool may be mounted with its guides facing upwardly to the front edge of an open-topped bin positioned on a workbench near a component placement machine so that it is readily accessible to the worker responsible for servicing that machine. Preferably, the tool is pivotally mounted so that it can be oriented horizontally or tilted upwardly depending upon the height of the user and whether or not he or she is sitting or standing.

To remove the retaining pins from a storage tube using the tool, the tube is grasped at one end such that the heads of the retaining pins face toward the tool. The worker then places the tube between the pair of guides spaced to receive that tube such that the pin at the far end of the tube is located beyond or rearwardly of the sharp rear edge of the tool. This automatically aligns the pin shank with the slot between those guides. Then, with a single pulling motion, the worker draws the tube along the channel between the guides causing the sharp edge segments on either side of the slot to engage between the head of the retaining pin and the wall of the storage tube facing the tool. The retaining pin is thus drawn along the slot so that the wedge-shaped plate at the edge margins of the slot pushes the pin head downward thereby pulling the pin out of the openings in the tube walls, whereupon the pin falls into the bin under the tool. The worker may then load the tube into a nearby component placement machine. Then, after the machine has ejected that tube, the worker, holding the tube by its opposite end, can use the same tool to remove the other retaining pin from the tube in the same manner.

A worker using our tool can remove retaining pins from storage tubes much more quickly and efficiently than before. Therefore, the tool reduces the non-value added time involved in removing these pins from the tubes. The tool should also reduce the incidence of wrist injury and trauma to the workers that perform the highly repetitive pin removal process and that should result in reduced sick time and insurance cost savings.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
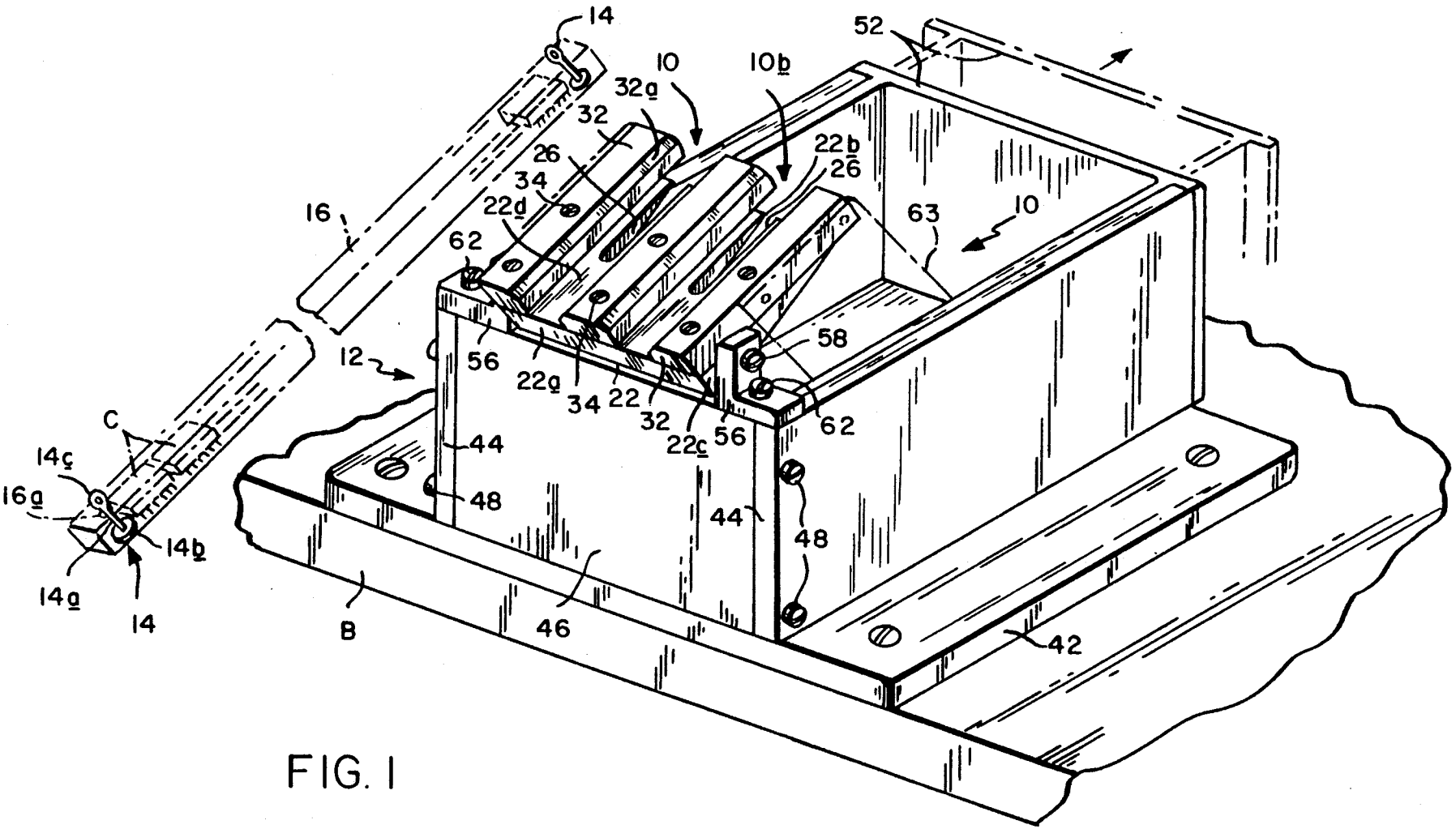
FIG. 1 is an isometric view of a pin pulling tool incorporating our invention.

Referring to FIG. 1, our pin removal tool, shown generally at 10, may be supported by a support shown generally at 12 which rests on a suitable workbench B. A worker standing or sitting in front of the workbench B may use tool 10 in order to quickly and efficiently remove the retaining pins 14 from a storage tube 16 used to house a plurality of electrical components. Typically, a tube 16 for containing components of the DIP type has a generally C-shaped cross section, e.g. ½ to 1 inch on a side, is long enough to hold 20 or more components C stacked end-to-end and is made of a rugged plastic material so that it can be reused several times.

The retaining pins 14 are also made of plastic material, but they are usually used only once. Each pin has a small diameter shank 14*a*, an enlarged discoid head 14*b* at one end of the shank and a resilient enlargement 14*c* at the opposite end of the shank. The length of the pin should be related to the cross section of the tube 16 such that when a pin is inserted through aligned holes 16*a* in the opposite walls of the tube at an end of the tube, the enlargement 14*c* can snap through the hole 16*a* remote from the pin head 14*b* thereby locking the pin in place so that the pin prevents the components C from escaping through that end of the tube 16. For example, a pin 14 for use with a tube 16 dimensioned as above may be about 0.56 inch long between its head 14*a* and its tip.

Figure 2:
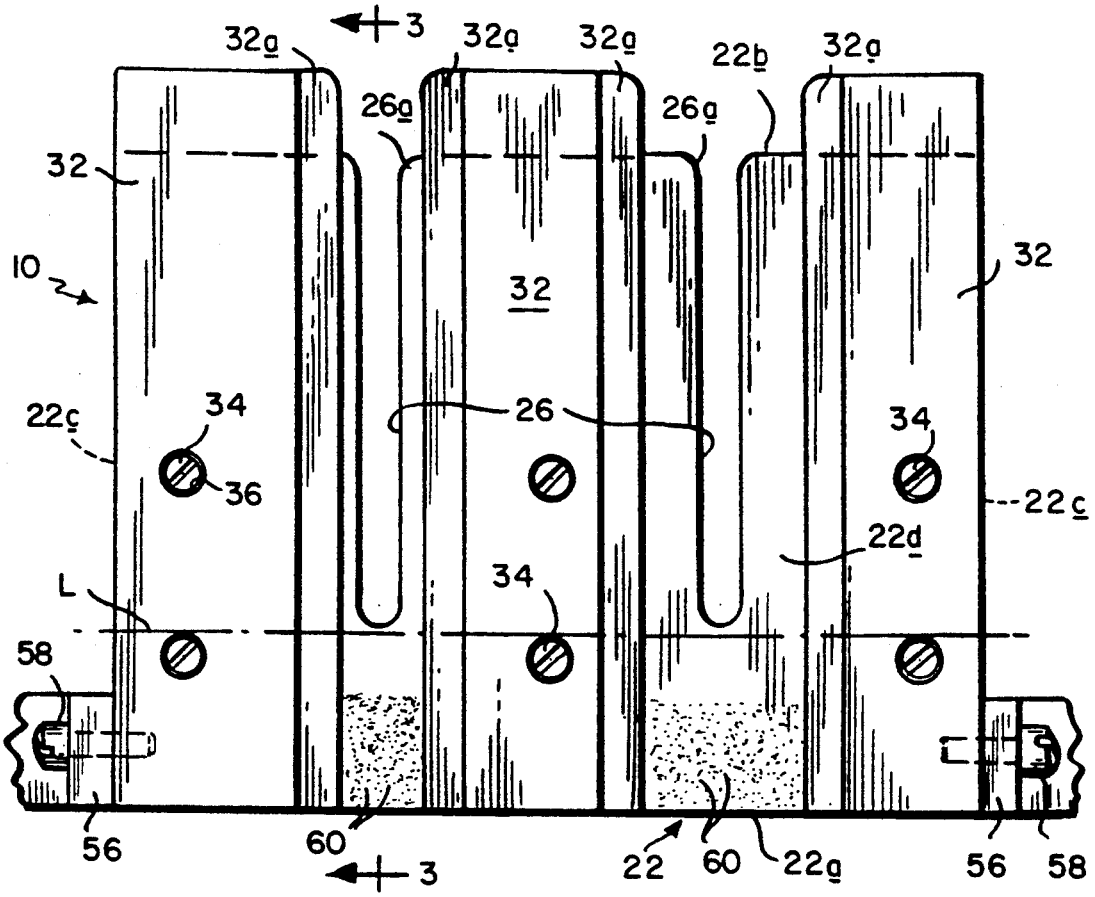
FIG. 2 is a top plan view on a larger scale and with parts broken away showing the FIG. 1 tool in greater detail.
Figure 3:
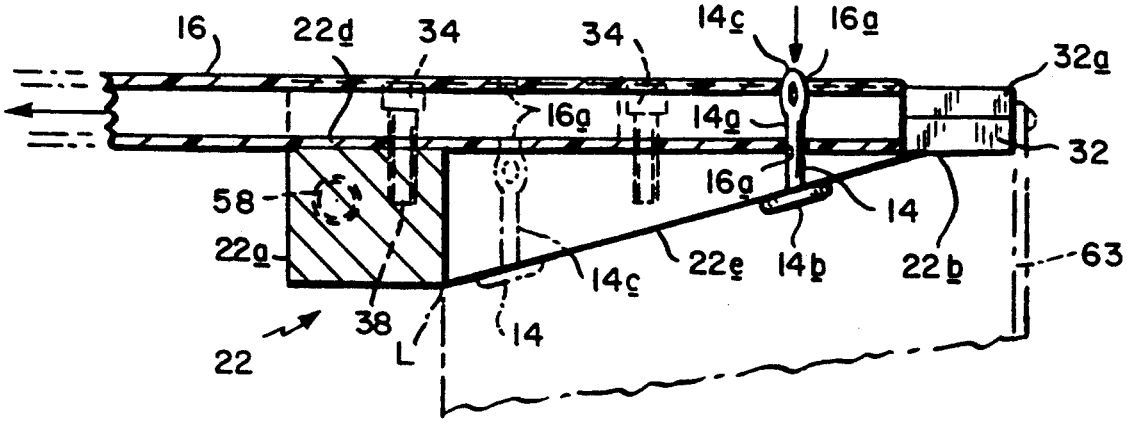
FIG. 3 is a sectional view taken along line 3—3 of FIG. 2.

Turning to FIGS. 2 and 3, tool 10 comprises a rigid, wedge-shaped plate 22. The plate may be made of metal such as steel or other suitable hard material. The illustrated plate has a relatively thick, e.g. 0.5 inch, front edge 22*a* and, in section, is tapered so that its rear edge 22*b* is relatively sharp forming a knife edge. The side edges 22*c* of plate 22 may be flat and more or less parallel to one another. Preferably, the upper or tube-engaging surface 22*d* of plate 22 is also flat, with the plate taper being created by an incline in the plate bottom surface 22*e* which, as best seen in FIGS. 2 and 3, extends from an imaginary line L spaced from the plate front edge 22*a* to the plate rear edge 22*b*. For a plate 22 which measures about 3 inches from front to back, line L may be about 2.75 inches from edge 22*a* resulting in a taper angle at edge 22*b* of about 15°. Of course, other taper angles between, say, 5° and 40° are also possible, depending upon the mechanical advantage desired for the tool. The thickness of plate 22 at line L should be greater than the pin length dimension noted above, e.g. 0.53 inch being a suitable thickness.

Plate 22 is formed with one or more relatively long slots 26 which extend in from the plate rear edge 22*b* and which extend all the way through the plate. Each slot 26 should be slightly wider than the diameter of the pin shank 14*a*, but narrower than the pin head 14*b*, e.g. about 0.19 inch, and the length of each slot may be comparable to the length of the tapered portion of the plate bottom wall 22*e*. Preferably, the plate corners 26*a* at the mouths of slots 26 are rounded so that the slot mouths are flared to facilitate entry into the slots of the pins 14 during the pin removal process to be described.

Referring to FIGS. 1 to 3, a plurality of elongated, generally rectangular guide members 32 are mounted to the upper surface 22*d* of block 22. The guide members are positioned parallel to one another and to slots 26 and are spaced apart across the plate so that a pair of such members brackets each slot. Thus, for the illustrated tool 10 having two slots 26, there are three guide members 32, two such members being located adjacent to the side edges 22*c* of the plate and one member being located between the slots 26. Adjacent guide members 32 are spaced apart a distance that is slightly greater than the cross section of the component tube 16 from which the tool 10 is to remove the pins 14.

For example, the guide members 32 bracketing the lefthand slot 26 in FIGS. 1 and 2 may be spaced 0.3 inch from the centerline of that slot 26 to accommodate tubes 16 which are 0.5 inch on a side. On the other hand, the guide members bracketing the righthand slot 26 in FIGS. 1 and 2 may be spaced 0.45 inch from the centerline of that slot to accommodate tube 16 having a wider, 0.8 inch cross section. The purpose of the guide members 32 is to define a slide or channel above each slot 26 which can slidably receive correspondingly sized tubes 16 when the tubes are positioned between the guide members. Preferably, the side walls of guide members 32 facing slots 26 are bevelled at 32*a* to facilitate entry of tubes 16 in the slots when the tool is being used. Preferably also, the guide members 32 are longer than the front-to-back dimension of plate 22 so that the guide members extend appreciably beyond the sharp rear edge 22*b* of the plate.

Members 32 may be secured permanently to the upper surface 22*d* of plate 22 by suitable means such as threaded fasteners 34 countersunk into vertical holes 36 in the guide members and turned down into threaded holes 38 in plate 32.

Referring to FIG. 1, tool 10 is shown mounted to a support 12 which also functions as a receptacle for the pins 14 pulled from each tube 16. Support 12 includes a base 42 which may be mounted, as shown, to workbench B, a pair of spaced-apart, upstanding, generally rectangular side walls 44 which are connected at their forward edge margins to the opposite ends of a generally rectangular end plate 46 by appropriate threaded fasteners 48. Slidably positioned on base 42 between side walls 44 is a pull-out drawer 52.

Tool 10 is mounted to the upper edge of end plate 46 at the forward end of support 12 by a pair of L-shaped brackets 56. Corresponding first legs of these brackets are connected by threaded fasteners 58 to the opposite side edges 22c of plate 22 near the forward edge 22a of that plate. Similar threaded fasteners 62 extending through the corresponding other legs of those brackets are threaded into the upper edge of end plate 46. By loosening fasteners 58, tool 10 can be pivoted so that it is horizontal, vertical or any desired angle in between to suit the worker using tool 10 whether he or she is sitting or standing.

When using tool 10 to remove the pins 14 from a tube 16, the assembly worker may stand or sit in front of workbench B and adjust the tilt of tool 10 to best suit him or her ergonomically. The worker picks up a tube 16 and grasps the tube at one end such that the pin heads 14b face tool 10. Then he or she places the opposite end of tube 16 in the channel between the lefthand or right-hand pair of guide members 32, depending upon the size of the tube. For example, if the tube 16 cross section is 0.5 inch on a side, the tube may be engaged in the left-hand channel whose guide members are spaced 0.6 inch apart.

To assist the worker in placing the tube properly in the tool, the guide members 32 and the plate surface 22d between the guides may be colored differently as indicated by the stippling 60 in FIG. 2. The guide member bevelled edges 32a and their extensions beyond the rear edge of plate 22 also facilitate the easy engagement of the tube in the tool channel so that the tube bottom wall rests on the rear edge of plate 22.

Then, the worker pulls tube 16 forwardly along the channel causing the knife edge 22b of plate 22 to engage under the pin head 14b as shown in solid lines in FIG. 3. Continued pulling motion draws pin 14 along slot 26 so that the inclined bottom face 22e of plate 22 bears against the pinhead 14b and wedges the pin out of the hole 16 in the tube upper wall, the pin enlargement 14c collapsing laterally as needed to squeeze through that hole as shown in FIG. 3. This wedging process continues until, by the time the pin has been pulled to the end of slot 26, the pin enlargement has been pulled completely from the hole 16 in the tube lower wall as shown in phantom in FIG. 3.

When the pin 14 is free of the tube 16, it drops into the drawer 52 rather than on the workbench B or the floor below. To assure this result for all angles of tool 10, a flexible shroud may be draped around the side and rear edges of plate 22 and extends to the inside walls 44 of the drawer 52, as shown in phantom at 63 in FIGS. 1 and 3, to direct the removed pins 14 into drawer 52.

After the pin at the far end of the tube is removed, the tube may be positioned in an automated placement machine which can access the components in the tube for assembly onto a printed circuit board. After all of the components have been removed from the tube, the worker, after grasping the other end of the tube, can remove the remaining pin 14 from the tube using tool 10 in the manner just described. Then the tube may be sent back to the component manufacturer for reuse or recycling.

When the drawer 52 fills up with removed pins 14, the drawer may be pulled out and emptied, with the pins being recycled or discarded as desired.

When using tool 10 to remove pins from a succession of tubes 16, a worker can usually find a rhythm whereby with a single swinging motion of the arm, he or she can position a tube in tool 10 and remove a pin 14 very quickly and with a minimum of effort. The removal process requires the use of only one hand and does not involve any twisting motion at the wrist. Therefore, pin removal using tool 10 should definitely minimize the incidence of wrist injury and cumulative trauma to the worker.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It should also be understood that the following claims are intended to cover all of the generic and specific features of the invention described herein.

We claim:

1. A tool for removing a pin that blocks an open end of an electrical component storage tube, the pin having a shank which extends through opposite walls of the tube and an enlarged head at one end of the shank, said tool comprising means defining a wedge having a relatively sharp edge and a tool-engaging surface extending away from that edge;

a slot in said wedge defining means, said slot having a mouth at said wedge edge and extending at a relatively sharp angle away from said edge and being wide enough to slidably receive the shank, but not the head, of said pin so that when the tube is positioned against said tool-engaging surface with the pin head located beyond said edge opposite the mouth of said slot and is pulled away from said edge in the general direction of said slot, said wedge defining means engages between the tube and the pin head and wedges the pin out of the tube.

2. The tool defined in claim 1 wherein said edge and said slot are relatively straight and orthogonal.

3. The tool defined in claim 1 and further including guide means mounted to said tool-engaging surface adjacent to said slot for engaging and guiding said tube in the direction of said slot.

4. The tool defined in claim 3 wherein said guide means overhang said wedge defining means so that they extend beyond said wedge edge.

5. The tool defined in claim 3 wherein said guide means comprise a pair of raised guide members mounted to said wedge defining means on opposite sides of said slot so that the members bracket said slot, said guide members having opposing generally parallel walls spaced apart a distance somewhat greater than the spacing of said tube walls.

6. The tool defined in claim 5 wherein said guide members extend beyond said edge.

7. The tool defined in claim 6 wherein the mouth of said slot is flared and said guide member opposing walls are bevelled.

8. The tool defined in claim 1 and further including support means for adjustably supporting said wedge defining means, said support means comprising a support;

means for pivotally mounting said wedge defining means to said support so that the wedge defining means can pivot about an axis that is spaced appreciably from and generally parallel to said edge between a first position in which said tool-engaging surface is generally horizontal and a second position in which said tool-engaging surface is generally vertical, and means for fixing the angular position of said wedge defining means.

9. The tool defined in claim 8 wherein said support includes an open-top receptacle, and said wedge defining means is mounted to the support so that it overlies said receptacle.

10. The tool defined in claim 9 and further including shroud means extending between said wedge defining means and said support to help direct the pins removed by said tool into said receptacle.

11. A tool for removing a pin that block an open end of an electrical component storage tube said pin having a shank which extends through opposite walls of the tube and an enlarged head at one end of the shank, said tool comprising a wedge having a relatively sharp edge and divergent first and second surfaces extending therefrom;

a slot in said wedge extending between said surfaces in a relatively straight line away from said edge to a location on the wedge at which the distance between said surfaces exceeds the length of said pin shank;

a pair of guide members mounted to said first surface on opposite sides of said slot, said guide members having opposite parallel walls spaced a fixed distance apart for engaging and guiding said tube in the general direction of said slot, the spacing of said walls being somewhat greater than that of said tube opposite walls, and means for supporting said wedge.

12. The tool defined in claim 11 wherein said supporting means comprise a support;

means for pivotally mounting said wedge to said support so that the wedge can pivot about an axis that is spaced appreciably from and generally parallel to said edge between a first position in which said first surface is generally horizontal and a second position in which said first surface is generally vertical, and means for fixing the angular position of said wedge.

13. The tool defined in claim 12 wherein said support includes an open-top receptacle, and said wedge is mounted to the support so that it overlies said receptacle.

14. The tool defined in claim 13 and further including a flexible shroud extending between said wedge and said support for directing pins removed by said tool into said receptacle.

15. The tool defined in claim 11 wherein said first and second surfaces of the wedge diverge at a selected angle between 5° and 40°.

16. The tool defined in claim 15 wherein the selected angle is 15°.

17. The tool defined in claim 11 and further including at least one additional slot in said wedge, each additional slot being spaced parallel to said slot, and at least one additional guide member mounted to said first surface adjacent to said one additional slot, said at least one additional guide member having a wall spaced opposite a wall of an adjacent guide member for engaging and guiding a said tube in the direction of said at least one additional slot.

18. The tool defined in claim 17 wherein the pairs of guide members bracketing different slots have different spacings for accommodating tubes of different widths.

19. The tool defined in claim 11 wherein said guide members extend beyond said wedge edge.

20. A method of removing the pins that block the open ends of an electrical component storage tube each pin having a shank which extends through opposite walls of the tube and an enlarged head at one end of the shank, said method comprising the steps of grasping the tube at one end so that the pin head at the opposite end of the tube faces away;

placing the tube against the edge of a slotted wedge whose slot extends along the wedge away from the said edge and is wider than said pin shank but narrower than said pin head;

pulling the tube along the wedge in the direction of the slot so that the pin shank enters said slot and the pin head engages under the wedge, and continuing the pulling until the wedge jacks the pin out of the tube.

* * * * *